United States Patent [19]

Holder et al.

[11] 3,952,176

[45] Apr. 20, 1976

[54] MULTIPLE POLE PUSHBUTTON ROTARY SWITCH

[75] Inventors: Paul Dalton Holder; Dale Bruce Alexander, both of Richardson, Tex.

[73] Assignee: Texas Instruments Incorporated, Dallas, Tex.

[22] Filed: Dec. 13, 1974

[21] Appl. No.: 532,664

[52] U.S. Cl. ..... 200/11 R; 58/23 R; 58/50 R; 58/85.5; 200/4; 200/11 K; 200/52 R; 200/159 R

[51] Int. Cl.[2] ..... H01H 13/52; H01H 19/10; G04C 9/00; G04B 27/00

[58] Field of Search ..... 58/23 R, 50 R, 57, 85.5, 58/4 A; 200/4, 11 R, 11 C, 11 E, 11 EA, 11 G, 11 J, 11 K, 16 A, 155 R, 156, 159 R, 336, 339, 340, 160

[56] References Cited

UNITED STATES PATENTS

| | | | |
|---|---|---|---|
| 2,511,618 | 6/1950 | Baur | 200/4 |
| 2,668,893 | 2/1954 | Vaughan | 200/159 R |
| 2,991,337 | 7/1961 | Reihman et al. | 200/11 R |
| 3,733,803 | 5/1973 | Hiraga et al. | 58/85.5 X |
| 3,869,586 | 3/1975 | Patz et al. | 200/11 G |
| 3,874,162 | 4/1975 | Boxberger et al. | 58/85.5 |
| 3,892,931 | 7/1975 | Lockard | 200/11 R |

FOREIGN PATENTS OR APPLICATIONS

| | | | |
|---|---|---|---|
| 580,803 | 9/1924 | France | 200/4 |

*Primary Examiner*—James R. Scott
*Attorney, Agent, or Firm*—Harold Levine; Edward J. Connors, Jr.; Stephen S. Sadacca

[57] ABSTRACT

A multiple pole bushbutton rotary switch has axial as well as rotary travel. A first dimple in the back of the rotor of a stem and rotor assembly is rotatable over a desired number of position indicating detents for selective positioning of the rotor. The stem is then pushable on its axis to make a second dimple located on the opposite surface of the rotor travel into a second detent on a substrate and make electrical contact between the rotor and contact within the second detent which is preferably coupled to circuit conductors on the substrate. An embodiment of the pushbutton rotary switch is particularly useful for controlling a plurality of different time-date setting functions of electronic watches with a single switch mechanism.

28 Claims, 8 Drawing Figures

Figure 1:
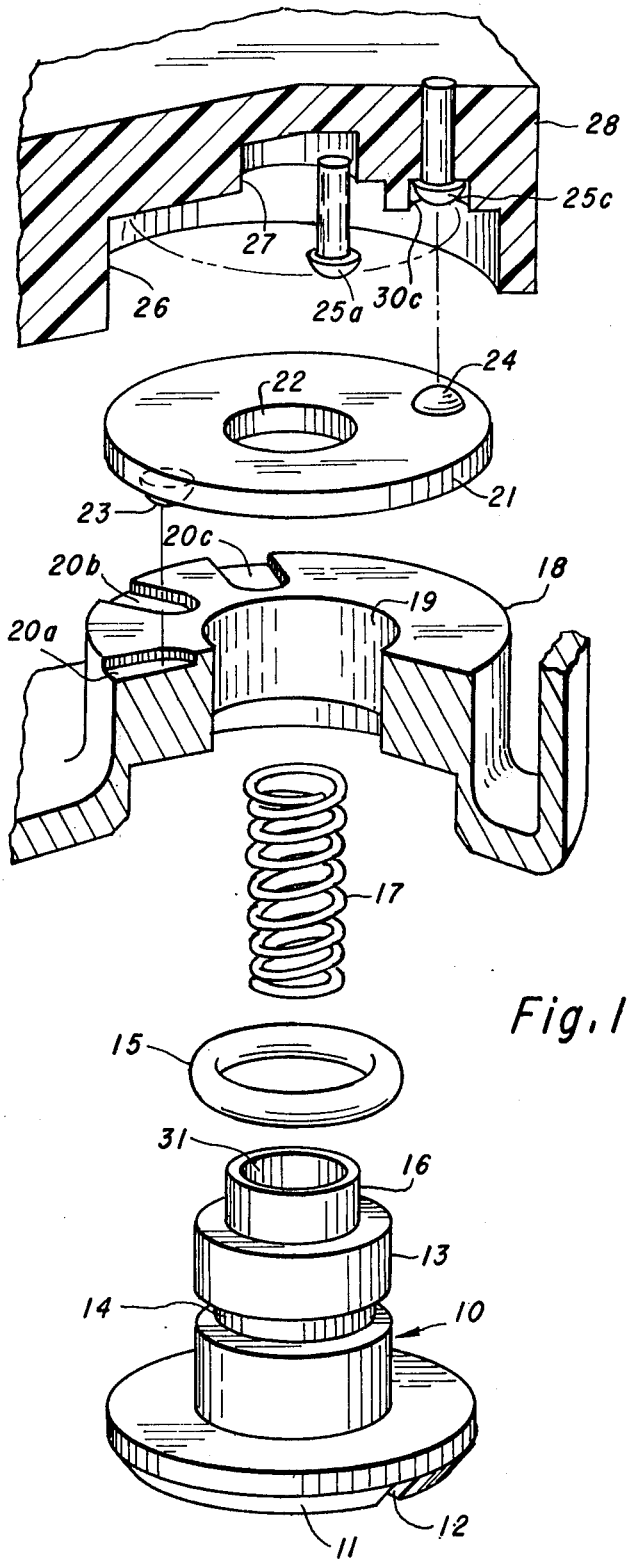

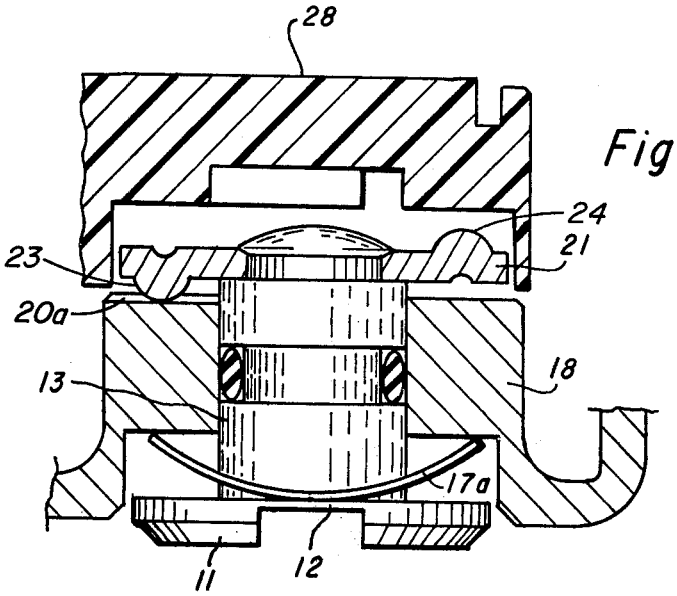
Fig. 4
Fig. 5
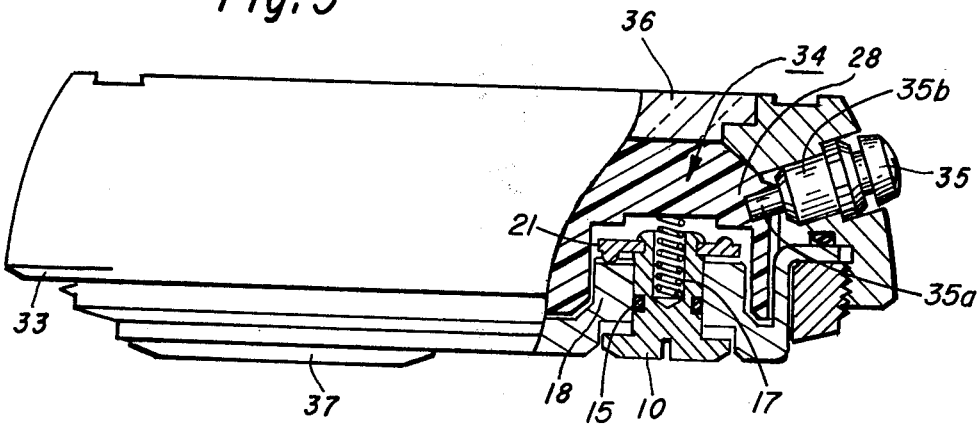

MULTIPLE POLE PUSHBUTTON ROTARY SWITCH

This invention relates to rotary switches and, more particularly, to a multiple pole pushbutton rotary switch.

Rotary switches are commonly utilized for making selective ohmic contact between one or more rotor wipers and a plurality of rotation selectable poles. The wiping action of such mechanisms is in general very inaccurate and the rotor wipers are fixed in such a manner that they make contact with undesirable poles for at least a short period of time as the rotor wiper passes over a plurality of poles when being rotated in order to reach a selected pole. Particularly in the case of logic circuitry being coupled to a conventional rotary switch, where even the shortest pulse on a bit line may be considered as a change in logic state, it is intolerable for the rotor to sweep over the poles while current is coupled to the rotary switch for passage between the wiper and poles. One solution to this problem has been to utilize separate external switches, such as pushbutton switches, coupled to the wipers or poles to provide an open circuit to the rotary switch while the rotary switch wipers are selecting poles. In other instances, such as in conventional electronic wrist watches, separate pushbuttons are utilized for each of a plurality of functions.

It would be desirable to provide a single pushbutton rotary switch which is rotatable to select indexed rotator pole combinations with the rotors out of electrical contact with all poles and which includes the capability of selective actuation of the rotor for bringing the rotor into electrical contact with the selected poles.

It is therefore an object of the present invention to provide a combined multiple pole pushbutton rotary switch.

It is another object of the invention to provide a rotary switch which is rotatable to select particular rotor-pole combinations without any contact between the rotor and poles and including the capability of selective actuation between the rotor and the selected poles.

A further object of the invention is to provide a single push-to-set switch for selectively and individually controlling a plurality of different setting functions of an electronic watch or the like such as for the individual setting of the minute and hour functions.

These and other objects are accomplished in accordance with the present invention in which a multiple pole pushbutton rotary switch is provided with axial as well as rotary travel. The stem and rotor assembly includes an indexing means, preferably a dimple on one surface of the rotor which sweeps over a desired number of indexing detents as the stem is rotated. The stem is normally spring biased in the index or selection position and is then capable of being pushed in on its axis making a second dimple correspondingly located on the opposite surface of the rotor travel into a second detent correspondingly located on a substrate and make electrical contact with a pole located therein. The pole may be a pin soldered to electronic circuitry also located on the substrate. With the stem rotor assembly being biased by the spring means, the rotor is rotatable a full 360° with the rotor contact means provided by the second dimple on the opposite surface of the rotor being completely out of contact with all poles.

In one embodiment, a coiled spring is utilized to normally bias the stem rotor assembly to provide the pushbutton actuator while in another embodiment a curved washer or leaf spring is utilized.

Figure 2B:
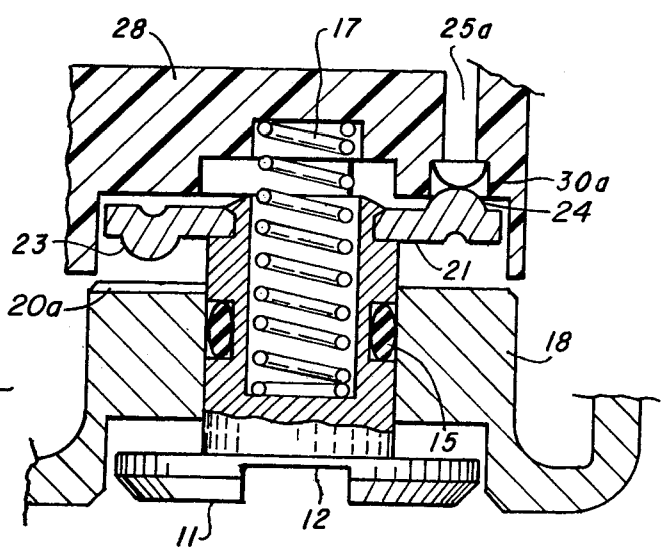
Figure 2A:
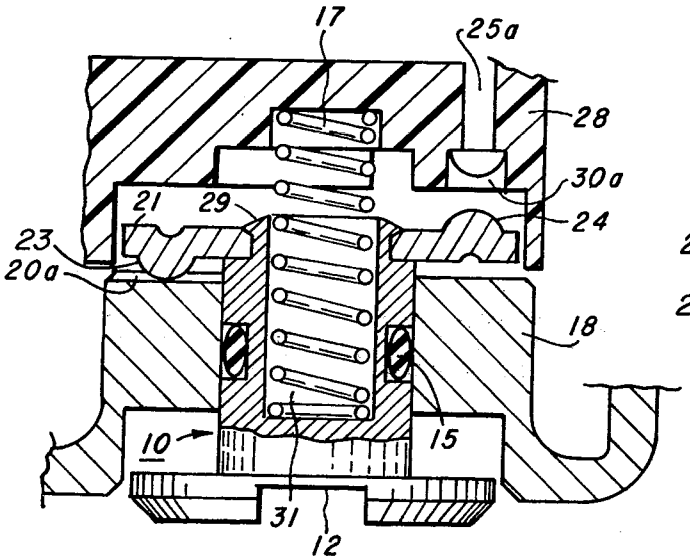
Figure 3A:
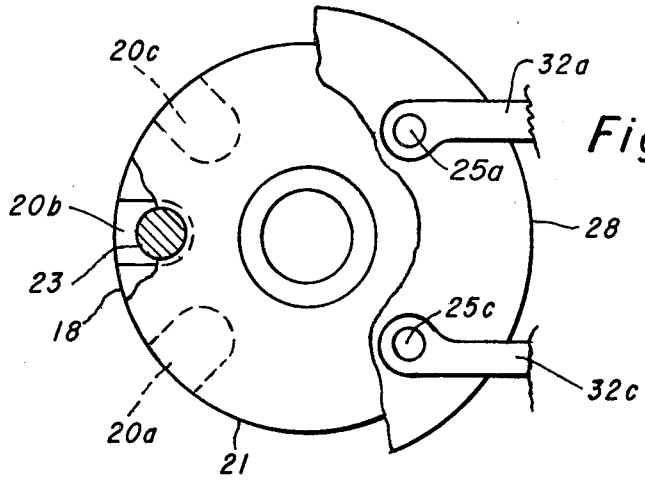
Figure 3B:
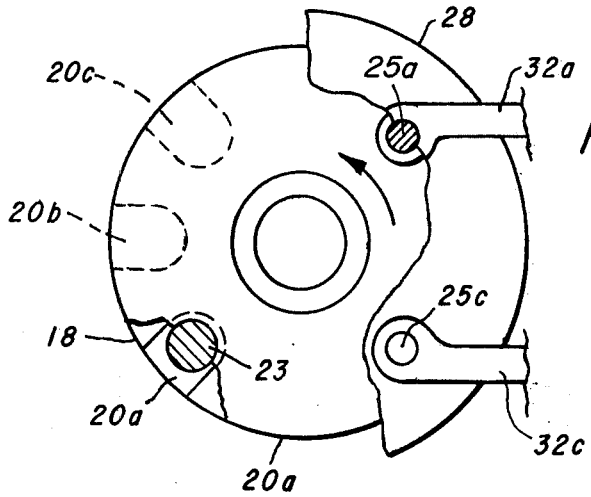
Figure 3C:
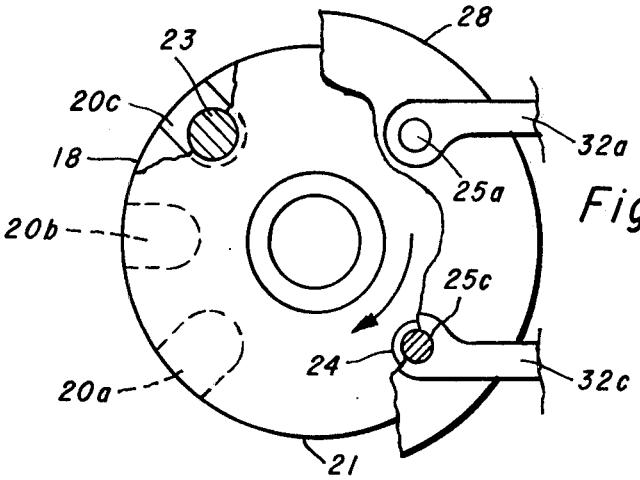

Still further objects and advantages of the invention will become apparent from the detailed description and claims and from the accompanying drawings wherein:

FIG. 1 is an exploded view of an embodiment of a rotary pushbutton switch in accordance with the present invention;

FIGS. 2*a* and 2*b* are cross-sectional views of the embodiment of FIG. 1 with FIG. 2*a* showing the switch in the unactuated indexing position and FIG. 2*b* showing the switch in an actuated state;

FIGS. 3*a*-3*c* are cutaway views of the rotor, detent and pole combinations illustrating the selection by the rotor of different ones of a plurality of poles in accordance with selectively placed indexing detents with the stem and rotor being in the unactuated indexing position;

FIG. 4 is a cross-sectional view of another embodiment of the rotary pushbutton switch in accordance with the present invention in which a leaf spring member is utilized for biasing the stem and rotor assembly; and FIG. 5 is a cutaway view of an electronic watch incorporating a pushbutton rotary switch embodied in the present invention for independent control of the setting of a plurality of different functions such as hours, minutes, seconds, day and/or date.

Referring then to FIGS. 1, 2*a* and 2*b*, a multiple pole pushbutton rotary switch embodied in the present invention is illustrated in detail. The switch includes a stem and rotor assembly which is comprised of stem member 10 and rotor member 21. The stem member includes a shaft 13 and a pushbutton-rotor head 11. A slot 12 is provided in head 11 to facilitate in the rotation of the stem and rotor assembly by means of an appropriate tool such as a screwdriver or coin. The rotor 21 is affixed to the shaft 13 of stem 10. This is accomplished, for example, by providing a centrally located opening 22 in rotor 21 which is inserted on reduced diameter portion 16 of shaft 13 with portion 16 being compressed to form an overlap 29 whereby stem member 10 is itself riveted to rotor 21.

The pushbutton rotary switch includes a lower body portion 18 having an opening 19 large enough to accept the shaft 13 which is both rotatable and axially movable therein. A sealing washer 15 comprised, for example, of a rubber or plastic material surrounds shaft 13 in the reduced diameter portion 14 to seal the stem within the opening 19 of body 18. The lower body portion 18 further includes a plurality of indexing detents such as 20*a*-20*c* which accept an indexing means such as dimple 23 formed on the under major surface of rotor 21. The stem 10 of the embodiment illustrated in FIG. 1, 2*a* and 2*b* includes a centrally located cavity 31 for accepting one end of a bias means such as coiled spring member 17.

The upper portion of the body 28 includes a cavity 27 of approximately equal diameter to the cavity 31 for accepting the opposite end of coiled spring member 17. The spring member 17 biases the rotor and stem assembly in the index or selection position normally away from the body 28 and pushes the rotor, particularly the dimple 23, against the body 18 so that the dimple 23 is sweepable over a desired number of the index detents 20*a*–20*c* as the stem is rotated for selection of a corresponding pole as shown in FIG. 2*a*.

A contact means such as a second dimple 24 is provided on the upper major surface of rotor 21 for selectively contacting corresponding electrically conductive poles 25*a*, 25*c* affixed to the body 28. The stem 10 is axially movable by means of pushing head 11 on its axis causing the dimple 24 to travel into a corresponding detent 30*a*, 30*c* to make ohmic contact between the rotor 21 ohmically coupled to the dimple 24 and a selected corresponding pole 25*a*, 25*c*. The body 28 may be comprised of a substrate such as a printed circuit board with the poles 25*a*, 25*c* respectively coupled through conductors 32*a*, 32*c* directly to electronic circuitry mounted on the substrate.

With the stem rotor assembly being biased by the spring member 17, the rotor 21 is rotatable a full 360° with the rotor contact means provided by dimple 24 being completely out of contact with all poles 25*a*, 25*c* as illustrated most clearly in FIG. 2*a*. FIGS. 3*a*-3*c* illustrate a particular embodiment of a switch according to the present invention in which the rotor 21 is indexed in three distinct positions by means of the dimple 23 and the index detents 23*a*, 23*c*. In the particular illustrated embodiment, the dimples 23 and 24 are 180° apart. As shown in FIG. 3*a*, detent 20*b* indexes a neutral position (no corresponding pole is provided on the substrate 28). As shown in FIG. 3*b*, detent 20*a* indexes rotor 21 so that the dimple 24 is in position to make ohmic contact with the pole contact member 25*a* upon axial actuation of stem 10 while FIG. 3*c* shows rotor 21 being indexed by detent 20*c* so that the dimple 24 is in position to make ohmic contact with the pole contact member 25*c* upon axial actuation of the stem 10. Although two active and one neutral position is shown in the embodiment of FIGS. 3*a*-3*c*, it is readily seen that any desirable number of such detents and corresponding conductive pole contact members may be provided. It is also readily seen that more than one dimple may be provided on the under surface of the rotor if additional support is desired.

As previously discussed, upper portion 28 of the body of the switch is preferably comprised of an electrically non-conductive material to provide an insulating substrate for the mounting of additional electrical conductors and components which are coupled to the switch. The lower portion 18 of the body of the switch is preferably comprised of an electrically conductive material in ohmic contact with the shaft and rotor assembly. The portion 18 may be in ohmic contact with the rotor 21 by means of shaft 13. Alternately, ohmic contact may be made between the rotor and a contact member located on the upper portion 28 of the body by means of an electrically conductive spring 17. The rotary switch may be further modified by placing one or more additional dimples on the upper surface of the rotor 21, one directly above the dimple 23, for example, with additional pole members provided in the upper portion 28 so that the conductive rotor may complete an electrically conductive path between two selected poles upon axial actuation of the stem 10.

A further embodiment of the invention is illustrated in FIG. 4 in which a flat curved leaf or washer spring 17*a* is utilized to bias the stem and rotor assembly instead of the coiled spring 17 illustrated in FIGS. 1 and 2*a*-2*b*.

FIG. 5 is a cutaway view of an electronic watch incorporating a pushbutton rotary switch embodied in the present invention for independent control of the setting of a plurality of different functions such as hours, minutes, seconds, day and/or date. A pole and index detent is provided for each desired function. The electronic watch may be of the continuous display type such as those employing liquid crystal displays or may be of the light emitter diode display type incorporating a filter lens 36 and demand pushbutton actuator switch 35. Actuator switch 35, which may be of the type described and claimed in copending patent application Ser. No. 532,665, filed of even date with and assigned to the assignee of the present invention, completes an electrical path from housing 36*b* to terminal member 35*a* in order to activate a light emitting display in a manner well known in the art. In the particular embodiment illustrated in FIG. 5, all of the circuitry including contacts to a demand switch 35, where applicable, a display visible through the lens or crystal 36, means for accepting a battery through battery hatch 37 and all the electronic timekeeping circuitry are contained on a substrate or module 34. The upper portion 28 of the main switch body is also part of the substrate or module 34. Body 18 of the rotary pushbutton switch incorporating the indexing detents, in this particular embodiment, is part of the watch housing 33. The watch housing is preferably at ground potential for the electronics and is ohmically coupled to battery ground by means of the hatch 37, to housing 35*b* of demand pushbutton actuation switch 35 and to the rotor plate of the pushbutton rotary switch by means of stem plunger member 10 which is in ohmic contact with body 18 and hence watch housing 33. Pole members 25*a* and 25*c* (not shown in FIG. 5) of the multiple pole pushbutton rotary switch of the present invention and terminal 35*a* of demand pushbutton actuator switch 35 (where applicable) are individually connected to the electronic timekeeping circuitry contained on substrate or module 34 by means conductors (not shown) as is well known in the art.

Various embodiments of the rotary switch in accordance with the present invention have been described in detail. Since it is obvious that many additional changes and modifications can be made in the above-described details without departing from the nature and spirit of the invention, it is understood that the invention is not to be limited to said details except as set forth in the appended claims.

What is claimed is:

1. A selective switch device comprising:

a housing having an elongated bore extending therethrough;

a plunger member slidably received within the bore of said housing and extending therethrough;

a rotor plate mounted on one end of said plunger member and extending radially outwardly therefrom in outwardly disposed relation to said housing, said housing having an end surface extending transversely with respect to said plunger and disposed in juxtaposition to said rotor plate;

means defining a plurality of indexing positions on one of said rotor plate and said end surface of said housing;

an indexing member on the other of said rotor plate and said end surface of said housing, said indexing member being selectably receivable by any one of said plurality of indexing positions;

an insulative end member secured to said housing and covering said one end of said plunger member and said rotor plate in opposed spaced relation thereto;

means defining a plurality of electrically conductive contacts on said end member corresponding to the plurality of indexing positions and disposed in opposed spaced relation to said rotor plate;

an electrically conductive contact member on said rotor plate for selective engagement with any one of said plurality of contacts on said end member;

means biasing said plunger member and said rotor plate carried thereby in a direction normally spacing said contact member on said rotor plate from said plurality of contacts on said end member and seating said indexing member in engagement with a selected one of said indexing positions;

the other end of said plunger member being exposed for manual rotation of said plunger member and said rotor plate carried thereby with respect to said housing to selectably seat said indexing member in engagement with any one of said plurality of indexing positions; and said contact member on said rotor plate being engageable with the particular contact on said end member corresponding to the selected indexing position in response to manual depression of said plunger member in a direction opposed to the direction in which said plunger member is urged by said biasing means.

2. The selective switch device according to claim 1 wherein said plunger member includes a head being exposed for facilitating the manual rotation and depression of said plunger member.

3. The selective switch device according to claim 2 wherein said head includes a selectively positioned slot visually indicative of the index position of said rotor plate carried by said plunger member.

4. The selective switch device according to claim 1 wherein said end surface of said housing includes a plurality of index detents radially formed on said end surface of said housing about said bore defining a plurality of indexing positions and wherein said rotor plate includes an indexing dimple member sweepable over and engageable in each of said detents.

5. The selective switch device according to claim 1 wherein said housing, plunger member and rotor plate are comprised of electrically conductive material.

6. The selective switch device according to claim 1 wherein said housing is the housing of an electronic wrist watch and wherein said plurality of contacts include a first contact for setting of hours and a second contact for setting of minutes.

7. The selective switch device according to claim 1 wherein said biasing means is comprised of a coiled spring member.

8. The selective switch device according to claim 1 wherein said bias means is comprised of a flat curved spring member.

9. The selective switch device according to claim 1 wherein said plunger member and rotor plate carried thereby are rotatable over a full 360° with the rotor contact member being isolated from all contacts on said end member.

10. The selective switch device according to claim 1 including a second electrically conductive contact member on said rotor plate for selective engagement with any one of a second plurality of contacts on said end member where said first and second contact members on said rotor plate are engageable with a particular pair of contacts on said end member corresponding to the selected indexing position in response to manual depression of said plunger member in a direction opposed to the direction in which said plunger member is urged by said biasing means for completion of an electrically conductive path between said pair of contacts.

11. The selective switch device according to claim 1 wherein said plurality of contact members are formed within locating openings in said end member for providing positive ohmic contact between said contact member on said rotor plate and the particular contact on said end member corresponding to the selected indexing position in response to manual depression of said plunger member in a direction opposed to the direction in which said plunger member is urged by said biasing means.

12. A rotary selection pushbutton switch comprising:

a. a first body having first and second opposite major surfaces with an opening therein extending from said first major surface to said second major surface and having a plurality of index detents on said first major surface radially formed about said opening;

b. a stem member including a shaft with a head formed at one end thereof, said shaft extending through the opening in said first body and being both radially and axially movable therein, said head extending over the second major surface of said first body;

c. an insulative second body disposed in a plane parallel to the first major surface of said first body in a secured relation with respect to and covering a portion of said first body, said second body having mounted thereon a plurality of electrically conductive pole members each respectively associated with a corresponding one of said index detents;

d. a rotor plate member on the opposite end of said shaft being carried by said shaft and extending over the second major surface of said first body in an opening between said first and second bodies, said rotor plate including indexing means sweepable over and engageable by said index detents for selective positioning of said rotor with respect to said body and an electrically conductive contact member for making selective ohmic contact between said rotor and selected ones of said poles; and e. bias means for normally biasing said shaft with said rotor plate against said second surface of said first body for engagement of said indexing means by said index detents; wherein f. said index member is carried by said rotor plate over said index detents and is engageable by said index detents for selective positive positioning of said rotor plate with respect to said first and second bodies; and wherein g. said stem is axially depressable against the force of said bias means for selectively making ohmic contact between the contact member and a corresponding pole member.

13. The switch according to claim 12 wherein said stem member includes a slot in said head with said head being exposed for facilitating the manual rotation of said stem member.

14. The switch according to claim 12 wherein said head includes a selectively positioned indicator means for visually indicating the index position of said rotor plate carried by said stem member.

15. The switch according to claim 12 wherein said first body, stem member and rotor plate are comprised of electrically conductive material.

16. The switch according to claim 15 wherein said substrate includes electronic circuitry mounted thereon and contact means ohmically connecting said pole members to said circuitry.

17. The switch according to claim 12 wherein said first body is the housing of an electronic wrist watch and wherein said plurality of poles include a first pole for the rapid setting of time and a second pole for the slow setting of time.

18. The switch according to claim 12 wherein said biasing means is comprised of a coiled spring member.

19. The switch according to claim 12 wherein said bias means is comprised of a flat curved spring member.

20. The switch according to claim 12 wherein said stem member with the rotor plate carried thereby are rotatable over a full 360° with the rotor contact member being biased in an isolated position from all contacts on said second body.

21. The switch device according to claim 12 including a second electrically conductive contact member on said rotor plate for selective engagement with any one of a second plurality of contacts on said second body wherein said first and second contact members on said rotor plate are engageable with selectively indexable pairs of contacts on said second body in response to manual depression of said stem member in a direction opposed to the direction in which said stem member is urged by said biasing means for completion of electrically conductive paths between said selected pairs of poles.

22. The switch according to claim 12 wherein said plurality of pole members are formed within locating openings in said second body for providing positive ohmic contact between the contact member on said rotor plate and each selectable pole on said second body in response to manual depression of said stem member in a direction opposed to the direction in which said stem member is urged by said biasing means.

23. A push-to-set switch for an electronic wrist watch comprising:

a. a watch housing having an elongated bore extending therethrough;

b. a stem member slidably received within the bore of said housing and extending therethrough;

c. a rotor plate mounted on one end of said stem member and extending radially outwardly therefrom in an outwardly disposed relation to said housing, said housing having an inner surface extending traversely with respect to said stem member and disposed in juxtaposition to said rotor plate;

d. means on said inner surface of said housing defining a plurality of indexing positions;

e. an indexing member on said rotor plate being selectably receivable by any one of said plurality of indexing positions;

f. an insulative substrate member in secured relation within said housing and covering said one end of said stem member and said rotor plate in opposed spaced relation thereto;

g. means defining a plurality of electrically conductive pole members on said substrate corresponding to the plurality of indexing positions and disposed in opposed spaced relation to said rotor plate, each said pole members being designated for the setting of a different function of said electronic watch;

h. an electrically conductive contact member on said rotor plate for selective engagement with any one of said plurality of pole members on said substrate member;

i. means biasing said stem member with said rotor plate carried thereby in a direction normally spacing said contact member on said rotor plate from said plurality of poles on said substrate member and seating said indexing member in engagement with a selected one of said indexing positions; wherein j. the other end of said stem member is exposed for manual rotation of said stem member and said rotor plate carried thereby with respect to said housing to selectably seat said indexing member in engagement with any one of said plurality of indexing positions and; wherein k. said contact member on said rotor plate is engageable with any particular pole on said substrate member corresponding to the selected indexing position in response to manual depression of said stem member in a direction opposed to the direction in which said stem member is urged by said biasing means to set a desired function of said electronic watch.

24. The switch according to claim 23 wherein said stem member includes an exposed head at said other end for facilitating the manual rotation and depression of said stem member.

25. The switch according to claim 24 wherein said head includes a selectively positioned slot for facilitating the manual rotation of said stem member with said slot being visually indicative of the function corresponding to the index position of said rotor plate carried by said stem member.

26. The switch according to claim 23 wherein one of said plurality of pole members corresponds to the function of setting of the hour and wherein another of said poles corresponds to the function of the setting of the minutes.

27. The switch according to claim 26 wherein further poles represent the setting of the function of seconds, date and/or day.

28. The switch according to claim 24 wherein said substrate includes electronic timekeeping circuitry to which said poles are connected by means of conductors selectively positioned on said substrate with said conductors being in ohmic contact with said pole members.

* * * * *